US008919593B2

(12) United States Patent
Sinacori et al.

(10) Patent No.: US 8,919,593 B2
(45) Date of Patent: Dec. 30, 2014

(54) LID AND RESILIENTLY BIASED CLOSURE SLIDER

(76) Inventors: Russell Sinacori, Charlotte, NC (US); Douglas Ramsey, Rochester, NY (US)

( * ) Notice: Subject to any disclaimer, the term of this patent is extended or adjusted under 35 U.S.C. 154(b) by 104 days.

(21) Appl. No.: 13/135,821

(22) Filed: Jul. 18, 2011

(65) Prior Publication Data

US 2012/0012585 A1 Jan. 19, 2012

Related U.S. Application Data

(60) Provisional application No. 61/399,691, filed on Jul. 16, 2010, provisional application No. 61/401,406, filed on Aug. 13, 2010.

(51) Int. Cl.

*B65D 43/26* (2006.01)
*B65D 47/26* (2006.01)
*B65D 47/28* (2006.01)

(52) U.S. Cl.

CPC .... *B65D 47/286* (2013.01); *B65D 2543/00046* (2013.01)
USPC ..... 220/254.9; 220/264; 220/715

(58) Field of Classification Search

USPC ..... 220/212.5, 252, 253, 254.1–254.5, 220/254.8, 254.9, 255, 256.1, 259.3, 259.5, 220/317, 318, 345.1–345.5, 348, 703, 711, 220/713–718, 756, 811–813, 846, 231, 262, 220/264, 361, 373, 375; 215/309
See application file for complete search history.

(56) References Cited

U.S. PATENT DOCUMENTS

| | | | | | |
|---|---|---|---|---|---|
| 1,511,613 | A | * | 10/1924 | Joern | 232/43.1 |
| D123,580 | S | * | 11/1940 | Van Woert, Sr. | D7/622 |
| 2,253,177 | A | * | 8/1941 | Hacmac | 222/498 |
| 2,274,849 | A | * | 3/1942 | Peterson | 222/470 |
| 2,304,214 | A | * | 12/1942 | Straub | 222/542 |
| 2,327,618 | A | * | 8/1943 | Bernhardt | 222/511 |
| 2,353,132 | A | * | 7/1944 | Louis | 366/243 |
| 2,380,906 | A | * | 7/1945 | Gessler | 222/511 |
| 2,447,870 | A | * | 8/1948 | Polcyn | 220/715 |
| D155,963 | S | * | 11/1949 | Alvarez | D7/619.1 |
| 2,574,338 | A | * | 11/1951 | Lewis | 222/473 |
| 2,578,201 | A | * | 12/1951 | Nicorvo | 215/315 |
| 2,884,157 | A | * | 4/1959 | Lampkin | 220/348 |
| 3,169,679 | A | * | 2/1965 | Hunter | 222/484 |
| 3,967,748 | A | * | 7/1976 | Albert | 220/715 |
| 3,972,443 | A | * | 8/1976 | Albert | 220/715 |
| 4,057,167 | A | * | 11/1977 | Lee | 220/715 |
| 4,094,433 | A | * | 6/1978 | Numbers | 220/715 |
| 4,099,642 | A | * | 7/1978 | Nergard | 220/715 |
| 4,127,212 | A | * | 11/1978 | Waterbury | 220/255.1 |
| 4,212,408 | A | * | 7/1980 | Valenzona | 220/254.5 |
| 4,276,992 | A | * | 7/1981 | Susich | 220/254.5 |

(Continued)

*Primary Examiner* — Anthony Stashick
*Assistant Examiner* — Ned A Walker
(74) *Attorney, Agent, or Firm* — Nifong, Kiefer and Klinck, PLLC

(57) ABSTRACT

A lid assembly includes a lid, which defines openings and a guide channel, and a body slidably engaging the lid and defining protrusions that correspond with the openings. A resiliently deformable member of the body is guided within the guide channel of the lid. The body is movable between a first position in which the openings and protrusions are aligned to block fluid flow and a second position in which the openings and protrusions are misaligned to allow fluid flow through the lid. The body is biased in the direction of the first position by the resiliently deformable member.

10 Claims, 8 Drawing Sheets

(56) References Cited

U.S. PATENT DOCUMENTS

| | | | | | |
|---|---|---|---|---|---|
| 4,303,173 | A * | 12/1981 | Nergard | 220/254.5 |
| 4,561,560 | A * | 12/1985 | Lyon | 220/278 |
| 4,570,817 | A * | 2/1986 | Hambleton et al. | 220/345.2 |
| 4,673,813 | A * | 6/1987 | Sanchez | 250/506.1 |
| 4,712,704 | A * | 12/1987 | Ramsey et al. | 220/254.4 |
| 4,819,829 | A * | 4/1989 | Rosten et al. | 220/345.3 |
| 5,036,993 | A * | 8/1991 | Ramsey | 220/254.6 |
| 5,082,134 | A * | 1/1992 | Ramsey | 220/711 |
| 5,086,941 | A * | 2/1992 | English et al. | 220/345.2 |
| 5,169,016 | A * | 12/1992 | Hinz, Jr. | 222/506 |
| 5,186,353 | A * | 2/1993 | Ramsey | 220/711 |
| 5,199,597 | A * | 4/1993 | Gladish | 220/715 |
| 5,307,950 | A * | 5/1994 | Li | 220/714 |
| 5,477,980 | A * | 12/1995 | Chaffin | 220/715 |
| 6,352,166 | B1 * | 3/2002 | Copeland | 220/254.2 |
| 6,439,442 | B1 * | 8/2002 | Markert et al. | 222/547 |
| 6,471,085 | B1 * | 10/2002 | Gallo | 220/501 |
| 6,557,717 | B1 * | 5/2003 | Keck | 220/254.9 |
| 6,752,287 | B1 * | 6/2004 | Lin | 220/254.9 |
| 6,824,003 | B1 * | 11/2004 | Wong | 220/254.9 |
| 7,195,137 | B2 * | 3/2007 | Belcastro | 222/484 |
| 7,275,653 | B2 * | 10/2007 | Tedford, Jr. | 220/254.9 |
| 7,413,096 | B2 * | 8/2008 | Morgan et al. | 220/254.9 |
| 7,416,093 | B2 * | 8/2008 | Lin et al. | 220/254.5 |
| 7,513,380 | B2 * | 4/2009 | Canedo | 220/230 |
| 7,546,933 | B2 * | 6/2009 | Pinelli | 220/715 |
| 7,591,389 | B2 * | 9/2009 | Wong | 220/254.9 |
| 7,611,029 | B2 * | 11/2009 | Wong | 220/254.9 |
| 7,731,047 | B2 * | 6/2010 | Ishimitsu | 220/254.4 |
| 7,753,224 | B2 * | 7/2010 | Cai | 220/254.9 |
| 7,845,510 | B2 * | 12/2010 | Schmidtner et al. | 220/254.9 |
| 7,850,037 | B2 * | 12/2010 | Schmidtner et al. | 220/713 |
| 7,874,447 | B2 * | 1/2011 | Schmidtner et al. | 220/254.9 |
| 7,997,442 | B2 * | 8/2011 | Pinelli | 220/715 |
| 8,215,344 | B2 * | 7/2012 | Windmiller | 141/113 |
| 8,556,137 | B2 * | 10/2013 | Vogel et al. | 222/515 |
| 2005/0029265 | A1 * | 2/2005 | Morgan et al. | 220/254.9 |
| 2005/0103787 | A1 * | 5/2005 | Simcovitch | 220/254.9 |
| 2005/0127075 | A1 * | 6/2005 | Smith et al. | 220/253 |
| 2005/0269325 | A1 * | 12/2005 | Belcastro | 220/254.3 |
| 2006/0081633 | A1 * | 4/2006 | Schmidtner et al. | 220/254.9 |
| 2006/0201945 | A1 * | 9/2006 | Tedford | 220/254.9 |
| 2006/0261068 | A1 * | 11/2006 | Schmidtner et al. | 220/254.9 |
| 2007/0170184 | A1 * | 7/2007 | Canedo | 220/254.9 |
| 2007/0215625 | A1 * | 9/2007 | Schmidtner et al. | 220/713 |
| 2007/0278228 | A1 * | 12/2007 | Wong | 220/254.9 |
| 2008/0029512 | A1 * | 2/2008 | Smith et al. | 220/253 |
| 2008/0073342 | A1 * | 3/2008 | Cai | 220/212 |
| 2008/0073343 | A1 * | 3/2008 | Shadrach et al. | 220/212 |
| 2008/0073347 | A1 * | 3/2008 | Shadrach | 220/254.9 |
| 2008/0190946 | A1 * | 8/2008 | Wong | 220/711 |
| 2010/0237033 | A1 * | 9/2010 | Windmiller | 215/2 |
| 2011/0068113 | A1 * | 3/2011 | Kim | 220/713 |

* cited by examiner

LID AND RESILIENTLY BIASED CLOSURE SLIDER

CROSS-REFERENCE TO RELATED APPLICATIONS

This application claims priority to U.S. Provisional Application No. 61/399,691 filed Jul. 16, 2010, and U.S. Provisional Application No. 61/401,406 filed Aug. 13, 2010, the contents of both of which are incorporated in their entirety by reference herein.

TECHNICAL FIELD AND BACKGROUND

The exemplary embodiments provided herein relate generally to the field of spill proof container lids, and more particularly, to lid assemblies including a lid having spaced-apart openings defined therethrough and a slider body defining corresponding protrusions that slidably engages the lid such that alignment of the protrusions and openings prevents the passage of fluid therethrough, and misalignment of the protrusions and openings permits the passage of fluid therethrough.

Various configurations of spill proof lids are well known in the art, however, disadvantages of conventional designs include two-handed operation, complexity, cleanability, poor fluid flow and cooperation with existing handles for operation, among other disadvantages. Accordingly, embodiments of lid assemblies are provided herein that overcome the disadvantages of prior art designs. The lid assemblies provided herein can advantageously be used with cups, disposable cups, mugs, tumblers and other container types, thus broad application among containers.

BRIEF SUMMARY

In one embodiment, a lid assembly is provided herein including a lid defining openings therethrough and a guide channel, and a body slidably engaging the lid and defining protrusions that correspond in position with the openings and a resiliently deformable member guided within the guide channel, wherein the body is movable between a first position in which the openings and protrusions are aligned to block a flow of fluid through the lid, and a second position in which the openings and protrusions are misaligned to allow a flow of fluid through the lid, and wherein engagement of the resiliently deformable member within the guide channel biases the body in the direction of the first position.

In a further aspect, the lid defines a recessed portion for receiving the body.

In a further aspect, the lid defines a recess for receiving a projection of the body.

In a further aspect, the openings are diametrically aligned on the lid.

In a further aspect, the body includes a lever assembly that biases a lever in a direction apart from a container associated with the lid.

In another embodiment, a lid assembly is provided herein including a lid defining a recess, first and second spaced-apart and diametrically aligned openings therethrough, and vertically-extending projections positioned between the first and second openings defining guide channels, and a slider body slidingly received within the recess, the slider body defining first and second protrusions on its underside that correspond in position with the first and second openings, and resiliently deformable features that are guided within the guide channels, wherein the slider body is movable between a first position in which the first and second openings and the first and second protrusions are aligned, respectively, to block a flow of fluid through the lid, and a second position in which the first and second openings and the first and second protrusions, respectively, are misaligned to allow a flow of fluid through the lid, and wherein engagement of the resiliently deformable features within the guide channels biases the slider body in the direction of the first position.

BRIEF DESCRIPTION OF THE DRAWINGS

Various features, aspects and advantages of the present invention are understood when the following detailed description of the invention is read with reference to the accompanying drawings, in which.

DETAILED DESCRIPTION OF THE INVENTION

Figure 1:
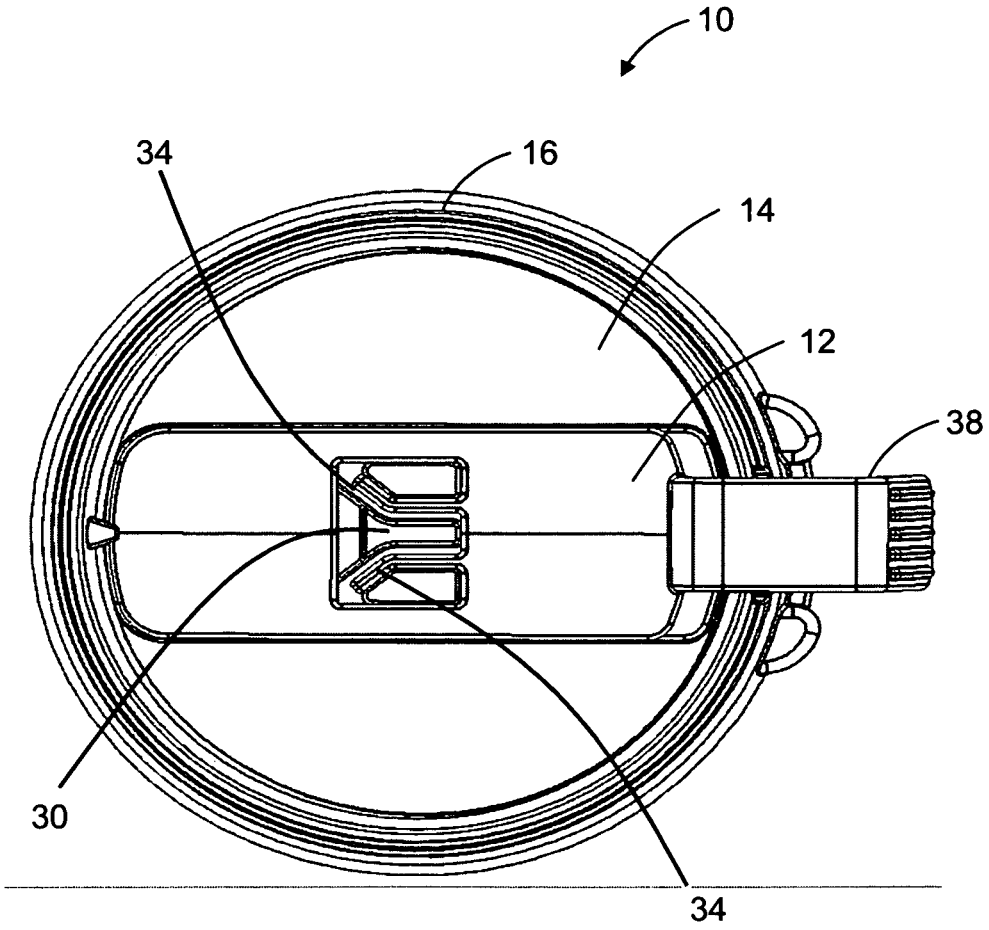
FIG. 1 is a top plan view of a lid assembly in accordance with an exemplary embodiment of the invention.
Figure 2:
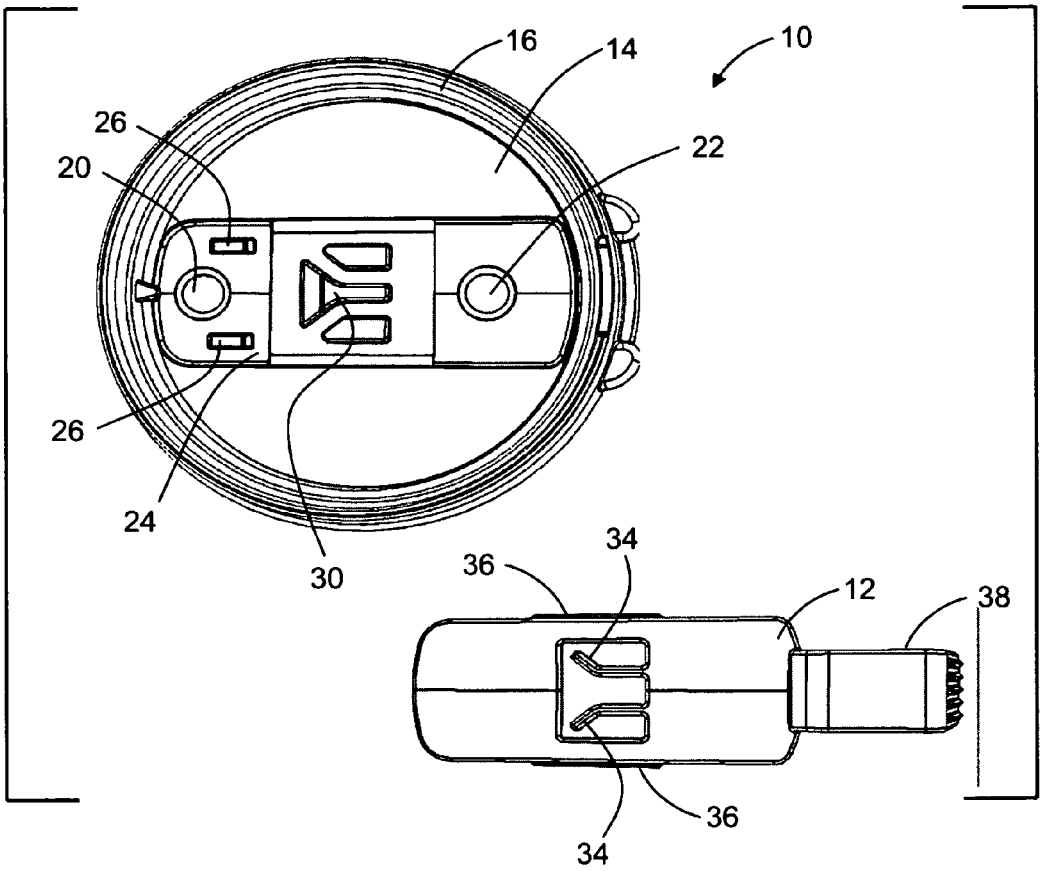
FIG. 2 is a top plan view of the lid assembly shown disassembled.
Figure 3:
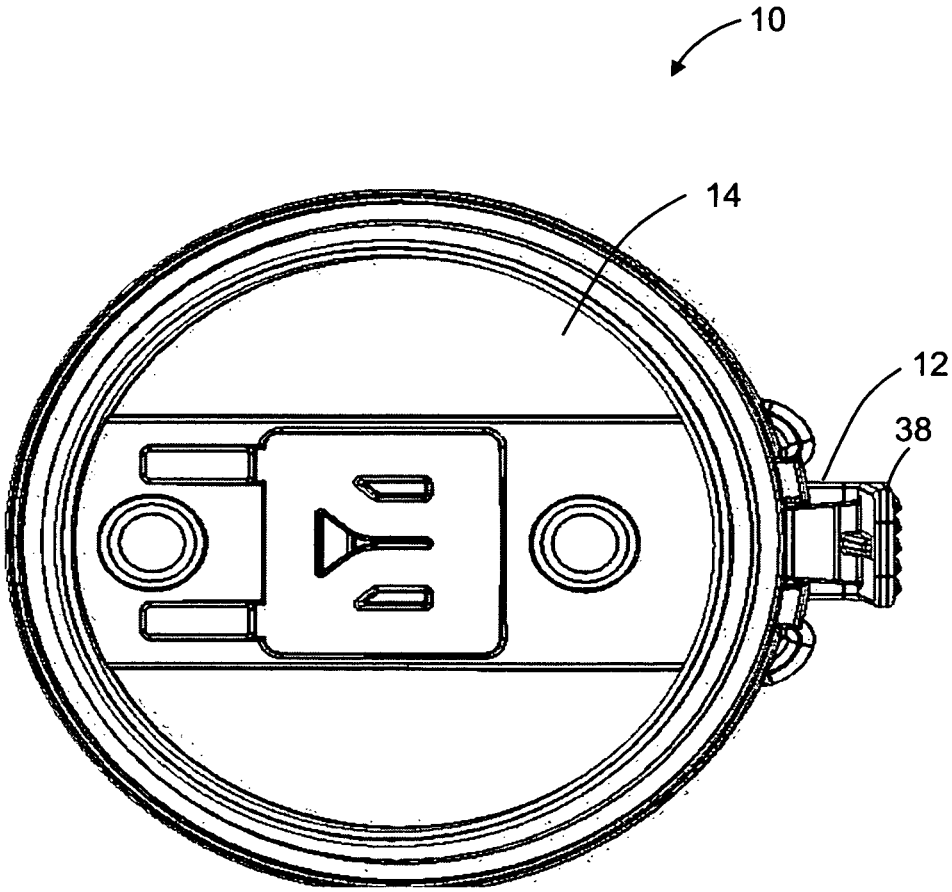
FIG. 3 is a bottom plan view of the lid assembly.
Figure 4:
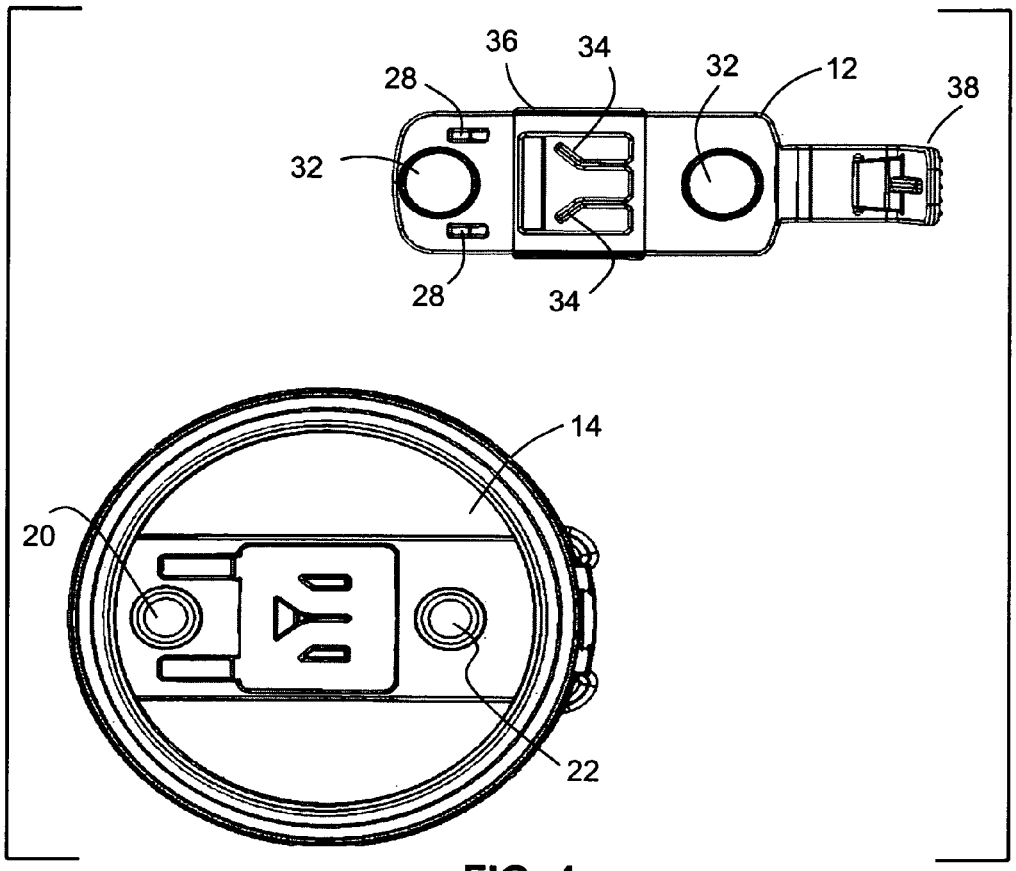
FIG. 4 is a bottom plan view of the lid assembly shown disassembled.
Figure 5:
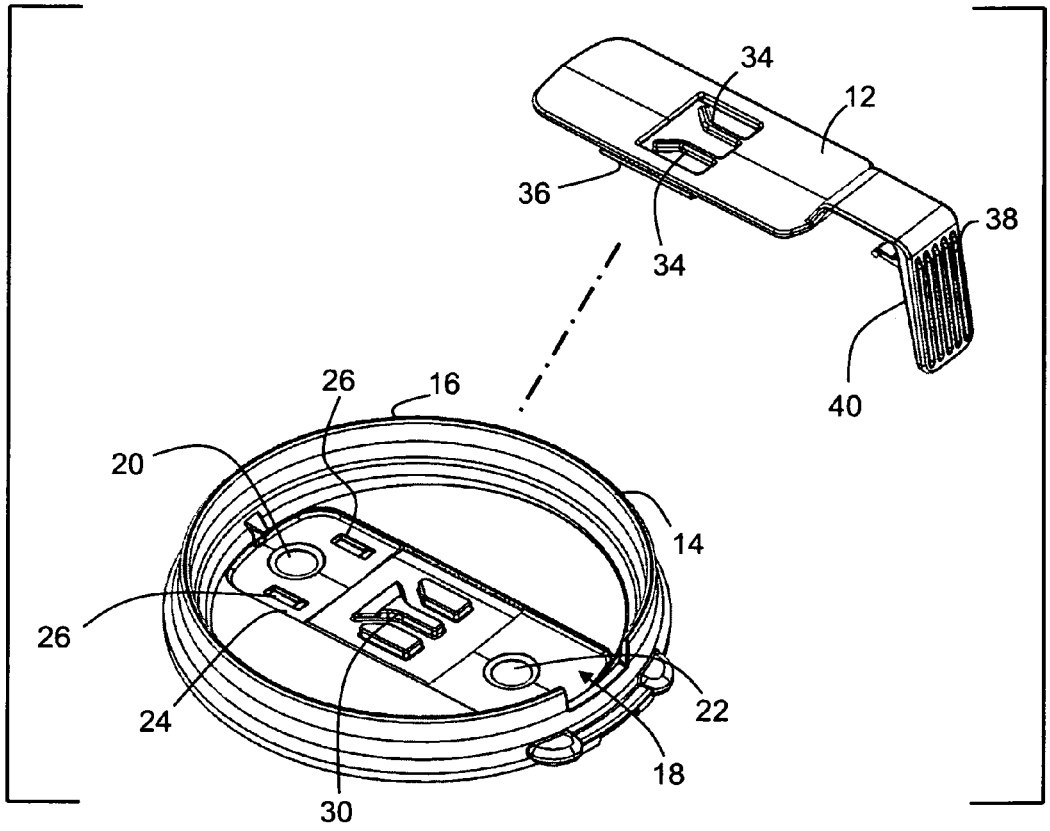
FIG. 5 is a perspective view of the lid assembly shown disassembled.

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention.

Referring to FIGS. 1-8, various illustrations of an exemplary embodiment of a container lid assembly are shown. It is intended that the lid assembly may be used with various container types including, but not limited to, mugs, tumblers, glasses, handled and non-handled containers, and other like containers, while requiring modification to the lid shape, size, sealing features etc. within routine skill of one in the art.

The lid assembly is shown throughout the figures at reference numeral 10, and generally operates through the sliding engagement of a slider body 12 with a lid 14. The lid 14 is a generally disc-shaped member having a vertically-extending annular flange 16 adjacent its perimeter for capturing fluid. The annular flange 16 has a break or "slot" 18 for positioning and clearing a portion of the slider body 12. The lid 14 defines diametrically-aligned first and second openings 20, 22 that are positioned inward of the perimeter of the lid. The openings 20, 22 are substantially spaced-apart such that, regardless of the orientation of an associated container, when handled, a typical drinking angle allows liquid to pass through one opening and air through the other. The openings 20, 22 are dimensioned to permit a sufficient amount of fluid to leave the container, and a sufficient amount of air to enter the container to prevent a vacuum effect. The openings 20, 22 may have a vertical sidewall or may define a chamfer for sealing engagement with protrusions of the slider body 12, as described in detail below. The slot 18, the first opening 20, and the second opening 22 are diametrically aligned.

The lid 14 further defines a recessed portion 24 within its top surface that has a shape generally corresponding to the generally rectangular portion of the slider body 12. The first and second openings 20, 22 are positioned spaced-apart and diametrically aligned within the recessed portion 24. Within the recessed portion 24 are further recesses 26 that are spaced-apart and positioned adjacent the first opening 20. The recesses 26 correspond in position with ramps 28 on the underside of the slider body 12 such that the recesses 26 and the ramps 28 are aligned and the slider body 12 can seat flush within recessed portion 24 in a first position in which the openings 20, 22 are "closed" and fluid is prevented from passing therethrough. In a second or "open" position, the ramps 28 and the recesses 26 are misaligned and the ramps 28 "ramp out" of the recesses 26 and move the slider body 12 upward relative to the lid 14. The slider body 12 translates relative to the recessed portion 24 along a diametrical axis through the first and second openings 20, 22, and is prevented from moving laterally within the recessed portion 24.

The lid 14 further defines vertically-extending protrusions 30 generally centrally located in recessed portion 24 that define guide channels for guiding corresponding features on the underside of the slider body 12. Translation of the slider body 12 within the recessed portion 24 causes the features on the underside of the slider body 12 to resiliently deform as they move within the guide channels and bias the slider body 12 in the direction against the direction of movement. Movement of the slider body 12 is actuated by moving a lever portion of the slider body 12, as described in detail below, relative to the associated container, which causes the slider body 12 to translate relative to the recessed portion 24. As the slider body 12 moves, the features of the slider body 12 are guided together in the channels defined by the projections 30. When the handled is released, the memory of the features of the slider body 12 causes them to move apart and travel in the opposite direction within the guide channels, causing the slider body 12 to return to the first or "closed" position. The features of the slider body 12 and the projections 30 can be oriented in either direction such that the slider body 12 can translate in either direction relative to the recessed portion 24. Thus, actuation of the handle can either "push" or "pull" the slider body 12 relative to the lid 14.

The slider body 12 defines generally hemispherical protrusions 32 on its underside that correspond in position to the first and second openings 20, 22. The protrusions 32 are generally hemispherical such that they sealingly engage within the first and second chamfered openings 20, 22. Centrally positioned between the protrusions 32 are the features, such as the resiliently deformable fingers 34 shown.

The slider body 12 may define tabs 36 on either side thereof that are received beneath flanges defined on opposing sides of the recessed portion 24. The engagement of the tabs 36 beneath the flanges resists against upward pulling forces on the slider body 12 and prevents unintentional disengagement of the slider body 12 from the lid 14. Installation of the slider body 12 in recessed portion 24 requires a slight downward pressing force on the slider body 12 to move the tabs 36 past their respective flanges.

The slider body 12 further includes a lever assembly 38 that passes through the slot 18 and engages the underside of the annular flange 16. The lever assembly 38 is outwardly biased, and in an exemplary embodiment includes a V-spring arrangement. In operation, the lever 40 is pressed toward the associated container, causing the protrusion carrying portion of slider body 12 to move toward the lever 40, consequently causing the protrusions 32 to withdraw from their respective openings both longitudinally and vertically as a result of the ramping action. Release of the lever 40 causes the biasing member to return lever 40 to its outward state, causing slider body 12 to return to its aligned, lowered position within the recessed portion 24, thus blocking openings 20, 22. As stated above, lever assembly 38 may be arranged to move slider body 12 in either direction relative to lid 14 to open and close the openings 20, 22.

Figure 6:
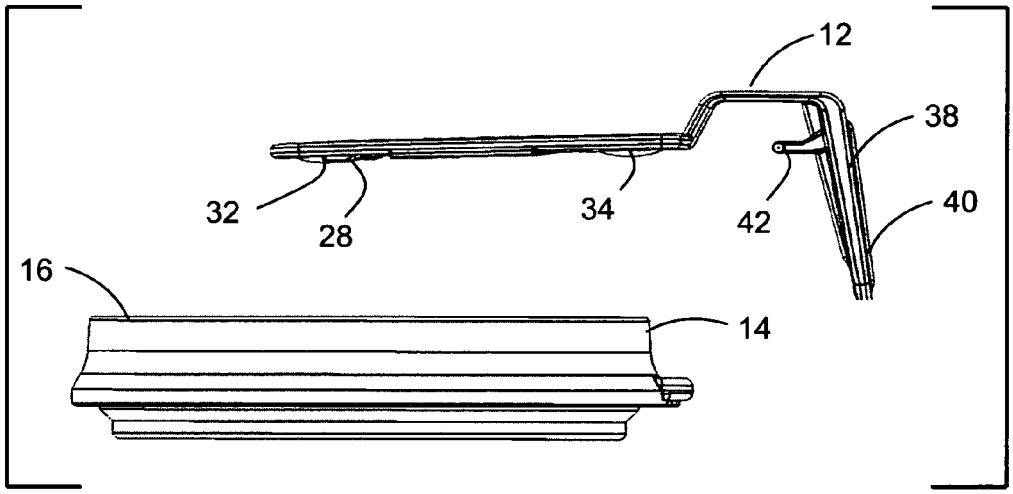
FIG. 6 is a side elevation view of the lid assembly shown disassembled.
Figure 7:
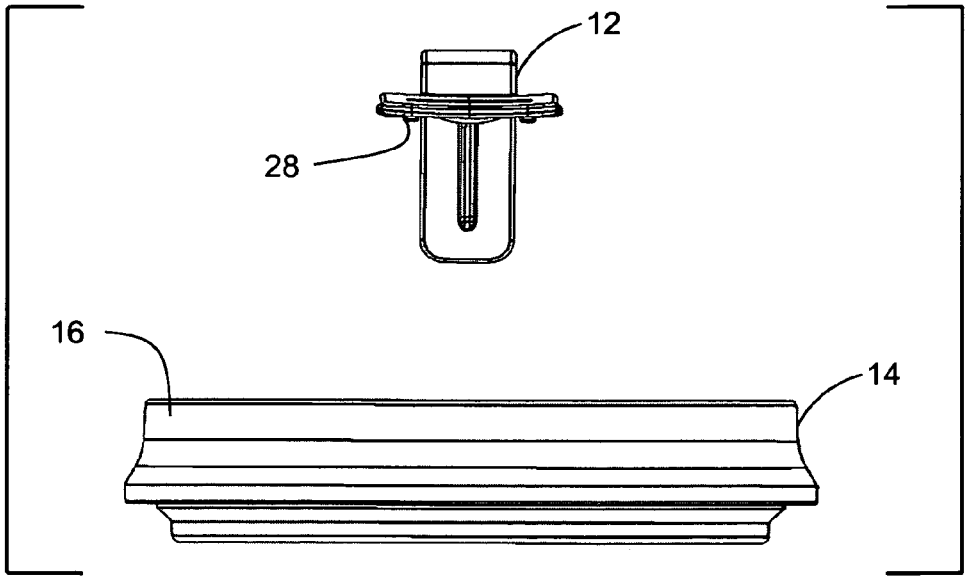
FIG. 7 is a front elevation view of the lid assembly shown disassembled.
Figure 8:
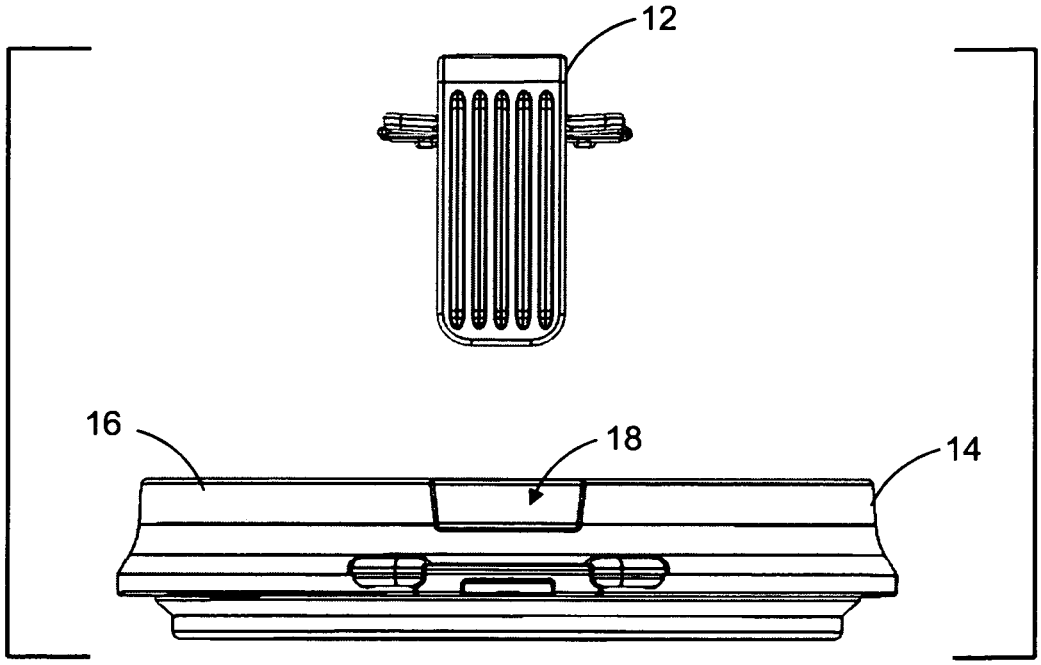
FIG. 8 is a rear elevation view of the lid assembly shown disassembled.

As best shown in FIG. 6, the slider body 12 defines a hook 42 that engages the underside of the lid 14 to further retain the slider body 12 on the lid 14. As shown, lid 14 defines specific geometry that sealingly engages a corresponding container, however, it is intended that other sealing geometries may be practiced to accommodate any shaped container without departing from the scope of the invention.

The slider body 12 and lid 14 may be constructed from any suitable material including various types of plastics known to those skilled in the art. It is intended that openings 20, 22 and protrusions 32 may have alternative positions, shapes and dimensions.

While a spill proof lid assembly has been described with reference to specific embodiments and examples, it is envisioned that various details of the invention may be changed without departing from the scope of the invention. Furthermore, the foregoing description of the preferred embodiments of the invention and best mode for practicing the invention are provided for the purpose of illustration only and not for the purpose of limitation.

What is claimed is:

1. A lid assembly, comprising:

a lid for covering a container, the lid comprising a top surface having a periphery, an annular flange extending upward from the periphery of the top surface, a recess extending diametrically across the top surface and having two opposing ends and two openings formed through the top surface proximal the two ends respectively, and protrusions extending upward from the top surface within the recess, the protrusions defining at least one guide channel; and an elongate closure body engaging the lid above the recess, the closure body comprising two downward extending protrusions that correspond respectively with the two openings, and a resiliently deformable member positioned within the guide channel, the closure body defining a unitary structure that includes the protrusions and the resiliently deformable member such that movement of the closure body relative to the lid includes movement of the protrusions and the resiliently deformable member relative to the lid;

wherein the closure body is movable between a first position in which the two openings and two protrusions are aligned to form a closed configuration of the lid, and a second position in which the resiliently deformable member is resiliently deformed within the guide channel biasing the closure body toward the first position and the openings and protrusions are misaligned to form an open configuration of the lid.

2. The lid assembly according to claim 1, wherein:

the lid comprises a first flange on a first side of the guide channel and a second flange on a second side of the guide channel opposite the first flange; and the closure body comprises a first tab received beneath the first flange and a second tab received beneath the second flange.

3. The lid assembly according to claim 1, wherein the openings are diametrically aligned on the lid.

4. The lid assembly according to claim 1, wherein the recess of the lid further comprises chamfered edges that define the two openings.

5. A spill proof lid assembly for covering a container and dispensing fluid, the spill proof lid assembly comprising:

a lid having a top surface, a recessed portion formed in the top surface, a first opening and a second opening formed through the recessed portion spaced-apart from and diametrically aligned with each other, and vertically-extending projections positioned in the recessed portion between the first and second openings defining guide channels; and a slider body slidingly received within the recessed portion, the slider body having a first side edge with a first tab and a second side edge with a second tab, a lower side facing the recessed portion, first and second protrusions that extend downward from the lower side and that correspond respectively with the first and second openings, and resiliently deformable members that are guided within the guide channels, the slider body defining a unitary structure that includes the protrusions and the resiliently deformable members such that movement of the slider body relative to the lid includes movement of the protrusions and the resiliently deformable members relative to the lid; and a pivotal lever extending outwardly and downwardly from the slider body, the pivotal lever integrally formed with the slider body and operating to slide the slider body between:

a first position in which the first and second openings are closed by the first and second protrusions, respectively, to block fluid from flowing through the lid, and a second position in which the first and second openings are staggered from the first and second protrusions, respectively, to allow fluid to flow through the lid.

6. The spill proof lid assembly according to claim 5, wherein:

the lid comprises a first flange along a first side of the recessed portion and a second flange on a second side of the recessed portion opposite the first flange; and the first tab of the slider body is received beneath the first flange and the second tab of the slider body is received beneath the second flange.

7. The spill proof lid assembly according to claim 5, wherein the slider body comprises ramps that are received, when the slider body is in the first position, by recesses formed in the recessed portion of the lid.

8. The spill proof lid assembly according to claim 5, wherein the lid comprises chamfered edges that define the first and second openings.

9. A closure for a liquid container, the closure comprising:

a generally circular lid comprising:

a generally circular upward facing surface defining a diametrical elongate recess, the recess having a first opening formed through the lid and a second opening formed through the lid, the first and second openings positioned proximal respective diametrically opposite ends of the recess;

a first flange depending from the upward facing surface and overhanging the elongate recess;

a second flange depending from the upward facing surface and overhanging the elongate recess opposite the first flange; and an annular rim extending upward from a periphery of the lid surrounding the recess; and two upwardly open guide channels defined in the recess; and a closure member comprising:

a body having a lower side facing the recess;

a first protrusion and a second protrusion that extend downward from the lower side of the body and correspond respectively with the first opening and second opening of the lid;

a first tab received in the recess under the first flange;

a second tab received in the recess under the second flange; and two resiliently deformable members positioned respectively at least partially within the two upwardly open guide channels of the lid, wherein the closure member is movable between:

a first position defining a closed configuration of the lid in which the first and second protrusions close the first and second openings, respectively; and a second position defining an open configuration of the lid in which:

the first and second protrusions are spaced from the first and second openings, respectively; and the two resiliently deformable members are deformed within the two upwardly open guide channels of the lid and bias the closure member toward the first position.

10. The spill proof lid assembly according to claim 5, wherein the resiliently deformable members of the slider body engage the guide channels to bias the slider body toward the first position when the slider body is displaced from the first position.

* * * * *